United States Patent [19]

Le Guen et al.

[11] Patent Number: 4,559,640

[45] Date of Patent: Dec. 17, 1985

[54] X-RAY TUBE CATHODE MULTIPLE POLARIZATION DEVICE AND A RADIATION SOURCE INCORPORATING SUCH A DEVICE

[75] Inventors: Jacques Le Guen; Jacques Delair; André Plessis, all of Paris, France

[73] Assignee: Thomson-CSF, Paris, France

[21] Appl. No.: 387,141

[22] Filed: Jun. 10, 1982

[30] Foreign Application Priority Data

Jun. 12, 1981 [FR] France ..... 81 11613

[51] Int. Cl.[4] ..... H05G 1/30

[52] U.S. Cl. ..... 378/113; 378/111; 378/138

[58] Field of Search ..... 378/113, 138, 139, 111, 378/112

[56] References Cited

U.S. PATENT DOCUMENTS 2,144,518 1/1939 Westendorp .

2,145,727 1/1939 Lloyd ..... 378/139

3,103,591 9/1963 Rogers ..... 378/138

3,916,202 10/1975 Heiting et al. .

4,143,298 3/1979 Bing et al. .

4,149,110 4/1979 Dallos .

*Primary Examiner*—Craig E. Church

*Attorney, Agent, or Firm*—Cushman, Darby & Cushman

[57] ABSTRACT

The invention relates to the polarization of a cathode of an X-ray tube by a high voltage cable comprising less conductors than the tube has polarization terminals. The missing voltages are processed by a device according to the invention, which comprises a voltage divider positioned between two of the voltages applied to the input terminals. It permits the use of standard long high voltage cables with limited stray capacitance without inducing dimensional control losses with respect to the tube foci.

Application to multifocus X-ray sources.

9 Claims, 3 Drawing Figures

FIG_1
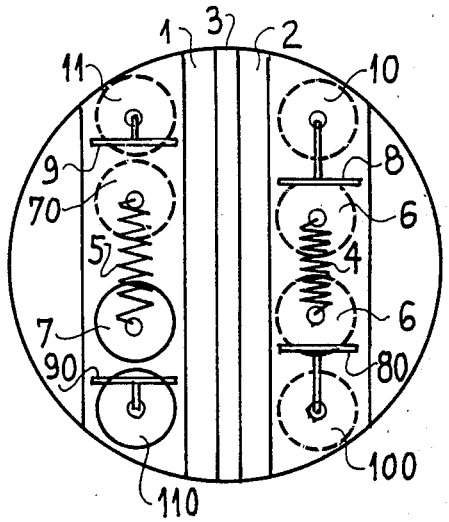
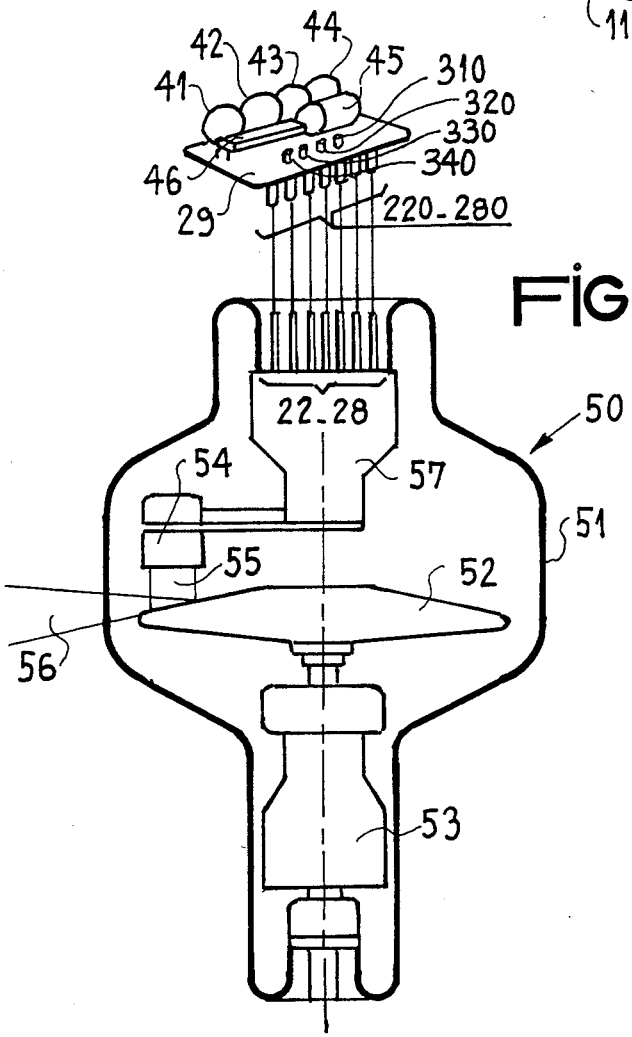
FIG_2

X-RAY TUBE CATHODE MULTIPLE POLARIZATION DEVICE AND A RADIATION SOURCE INCORPORATING SUCH A DEVICE

BACKGROUND OF THE INVENTION

The present invention relates to an X-ray tube cathode multiple polarization device and to a radiation source incorporating such a device. It is intended for use in radiology and more particularly for multifocus tubes. It makes it possible in an advantageous manner to reduce the number of conductors in the cable for supplying high voltage to the sheath and increases the flexibility of use of radiation sources.

In radiology, it has been found that the obtaining of good images, both in conventional image production and in image production by reconstruction assisted by a computer, largely depends on the shape and dimensions of the radiation emitter focus. One widely used tube type comprises two selectively switched filaments for producing a large or a small focus as a function of the polarization.

In radiology, it is often necessary to have more dimensions available. For this purpose, it has been proposed to provide the cathode with focusing electrodes raised to the cathode potential. It has also been proposed to mechanically regulate the length of the filament. It has also been proposed to arrange perpendicular to the filament axis and on either side of the latter, two concentrating parts, which are electrically insulated from the shell and raised to a potential regulatable as a function of the desired length. Finally, it has been proposed in the latter case to have two filaments with a common centre polarization terminal. One of these is added to the other for varying the length of the focus by step, which limits for example, the variation of the concentration voltage of the aforementioned parts.

The polarization of these various auxiliary members is ensured by a cable having a plurality of conductors from the high voltage generator to the tube or radiation source, which is often at a distance of several meters. This is disadvantageous from two standpoints. Firstly, a cable with a plurality of conductors increases in cost with the number of conductors and their number is limited on the presently proposed equipment. In addition, the length and number of conductors in a cable increases the reactive part of the cable impedance. This leads to a by no means negligible pulse transmission time, when it is a question of operating a tube at a high speed, as is the case in X-ray cinematography or X-ray scanning. Furthermore, stray capacitances cause, when switching on, a sudden drop in the polarization voltages and consequently a loss of dimensional control of the foci.

BRIEF SUMMARY OF THE INVENTION

The present invention obviates the difficulties of the prior art. Thus, the radiation source is connected to the high voltage generator by a cable, whilst the concentrating parts are polarized by a polarization device located within the sheath in which is located the X-ray tube.

A further advantage of the invention is that it provides a polarization unit, which matches the impedance of the tube to that of the high voltage generator.

According to the invention, a polarization unit for an X-ray tube is characterized in that the polarization device is carried by the actual tube and comprises active component for transforming the voltage supplied by the radiological generator.

BRIEF DESCRIPTION OF THE DRAWINGS

The invention is described in greater detail hereinafter relative to non-limitative embodiments and the attached drawings, wherein:

FIG. 1 is the diagram of a conventional two-filament cathode.

FIG. 2 is the diagram of an X-ray tube with a multiple polarization device according to the invention before being connected to the tube.

DETAILED DESCRIPTION OF THE PREFERRED EMBODIMENTS

Figure 3:
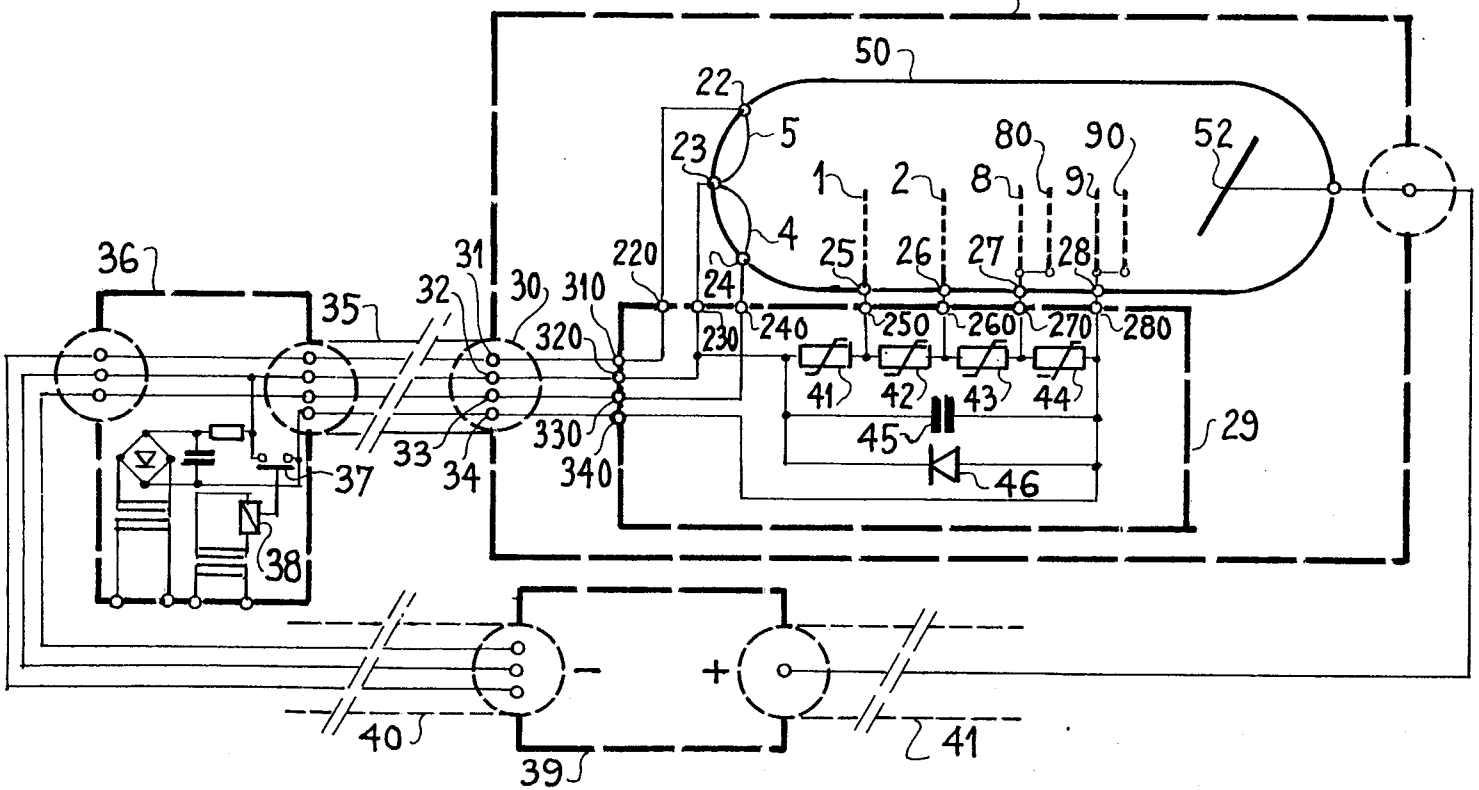
FIG. 3 is the complete diagram of a radiological installation according to the invention.

The different parts of an X-ray tube necessary for the understanding of the invention are explained relative to FIGS. 1 and 2. At the bottom of FIG. 2 X-ray tube 50 comprises in a glass envelope 51, a rotary anode 52, an electric motor rotor 53 for rotating anode 52 and a cathode 54, which produces an electron beam 55 for bombarding the inclined part of the anode disk 52.

An x-ray beam 56 is emitted or transmitted from a focus corresponding to the area bombarded by electron beam 55. Finally, a cathode leg 57 carries cathode 54 and a series of seven pins 22–28 for supplying cathode 54.

FIG. 1 is a plan view of cathode 54. The concentrating parts 1 and 2, which are electrically insulated from one another by insulating material 3, receives the transmitting filaments 4, 5. The latter are respectively mechanically held on concentrating parts 1, 2 by insulating supports 6, 60 and 7, 70. The lateral concentrating plates 8, 80 and 9, 90 are themselves mechanically fixed to concentrating parts 1 and 2 by insulating supports 10, 100 and 11, 110.

Thus, in the prior art, the tube can receive a large number of voltages through a multiconductor cable from a polarization generator supplied by a high voltage generator, the two generators being remote from the radiation source.

This is disadvantageous in two ways. Firstly, a high voltage cable becomes more expensive as the number of conductors increases and the number is limited to four on the presently proposed equipment. In addition, stray capacitances during the high voltage application phase cause transient phenomena and in an erratic manner lead to sudden drops of the polarization voltages and consequently to a dimensional control loss with respect to the foci. These phenomena become even more pronounced when the tube is operating at high speeds, as is for example the case in X-ray cinematography.

These different voltages consist of the heating of the filaments 4, 5, which require three voltages because they have a common point, together with the lateral and longitudinal concentration of each beam requiring two separate voltages, i.e. four separate voltages for the two beams.

According to the invention, for supplying the seven voltages to tube 50, a polarization device 29, as shown in FIG. 2, is used and only has to be connected to the polarization generator by a standard four-conductor high voltage cable. Thus, this device is very advantageous and relatively inexpensive. It only has four active polarization elements 41–44, a capacitor 45, a semiconductor diode 46, four input terminals 310–340 and seven output terminals 220–280 for fitting to the terminals 22–28 of the cathode leg 57 of X-ray tube 50. These components are installed on a carrier printed circuit 29, which is fixed to the tube by the seven aforementioned terminals.

FIG. 3 diagrammatically shows a radiology installation, whose main components are the high voltage generator 39, the polarization generator 36, the X-ray tube 50, the device according to the invention 29, protective sheath 13 and the high voltage interconnection cables 35, 40 and 41.

X-ray tube 50 comprises a rotary or fixed anode 52, a cathode whose operation has been described in FIG. 1 and whose constituent parts are consequently two filaments 4, 5, two concentrating parts 1, 2 and two pairs of lateral concentration plates 8, 80 and 9, 90.

The vacuum-tight outputs of the seven cathode elements 22 to 28 are connected to a printed circuit 29 carried by an X-ray tube 50 from which the printed circuit 29 is connected to the negative high voltage termination 30 comprising four pins and integral with protective sheath 13.

The negative high voltage supply cable 35 having only four wires 31, 32, 33, 34 is connected to polarization generator 36, which supplies a single negative polarization voltage to wire 34, the other positive polarity being connected to the common heating wire 32. A contact 37 controlled by an insulated high voltage relay 38 makes it possible to short-circuit the polarization voltage and consequently bring wires 32 and 34 to the same potential.

This polarization generator 36 is connected to the negative polarity of the high d.c. voltage generator 39 by a high voltage cable 40 having three conductors permitting the continuity of the filament circuit. The positive polarity of high voltage generator 39 is connected to the sheath 13 by high voltage cable 41.

The following description serves to explain the operation of the device according to the invention permitting the obtaining of the aforementioned advantages, i.e.:

(1) the use of a standard high voltage cable, (2) an effective control of the focusing voltages of the multifocus tubes.

Printed circuit 29 is on the one hand equipped with a line of voltage limiters 41 to 44, which are also called varistors and in this case serve as voltage dividers. All the polarization voltage is applied to this line of components which, for a predetermined threshold, is traversed by a low current of a few microamperes. Thus, at the terminals of each of these components there is a fixed voltage dependent on their characteristics, said voltages being linked with the different focusing electrodes constituting the cathode of the X-ray tube.

In order to eliminate the phenomena due to the stray capacitances of cable 35, it is necessary to supplement voltage divider 41–44 by a transient suppressing device.

On printed circuit 29 are installed on the one hand a capacitor 45 and on the other a diode 46. In the static state (with no high voltages) the polarization source of generator 36 charges capacitor 45 at the maximum voltage. On applying high voltage, the stray capacitances of the high voltage cables 35 lead to a sudden polarization voltage drop (temporary short-circuit of points 320 and 340), but diode 46 prevents a discharge of capacitor 45. The polarization voltage is maintained on the focusing electrodes on the one hand because the consumption of the line of varistors is low and on the other because the transient phenomenon due to stray impedances is of short duration.

On return to the static state (without high voltage), the polarization source completes the charging of capacitor 45. As a result of this system, the fastest exposure repeat cycles used in X-ray cinematography are possible.

The present invention can be used in connection with any technical problem involving a reduction of the voltage supplies. On the basis of a high voltage and a low voltage it is possible to supply as a result thereof virtually without loss a group of n intermediate voltages by means of voltage dividers with n varistors. The charge losses when switching on are effectively counterbalanced by the diode-capacitor pair.

The varistors (or voltage-dependent resistors) can be of the metal oxide semiconductor type (MOS). These elements have a much more inflexible current-voltage characteristic than that of conventional silicon carbide varistors. Locally, at a non-zero voltage, the characteristics are similar and can be approximated by an exponential function, whose coefficient is close to 8 or 9 for SiC varistors and above 30 for MOS varistors. The low consumption of MOS varistors is ensured by starting the voltage at about 50 to 100 microamperes, the voltage varying very little as a function of the intensity. As soon as the varistor is traversed by a current, it supplies a voltage at its terminals. The very low response time, useful for uses in frequency as for X-ray cinematography, is ensured by the very low current consumption.

What is claimed is:

1. An apparatus for producing X-rays, comprising:

an X-ray tube including:

a protective sheath;

a vacuum-tight envelope disposed in said sheath;

a cathode comprising a plurality of filaments and a plurality of concentrating elements, said cathode disposed in said envelope;

cathode supporting structure means, disposed in said envelope, for mechanically supporting and electrically isolating said plurality of filaments and said plurality of said concentrating elements, said structure means including a plurality of respective electrical terminal means extending outside of said envelope for electrically connecting with said plurality of filaments and said plurality of concentrating elements; and an anode disposed in said envelope;

polarization voltage generating means for producing a polarization voltage;

voltage divider means, disposed in said protective sheath, electrically connected to said terminal means and to said polarization voltage produced by said generating means, for producing a plurality of fixed predetermined voltage levels and for applying said plurality of fixed voltage levels to said terminal means, said voltage divider means comprising a plurality of active elements; and high voltage cable means for electrically connecting said generating means to said voltage divider means.

2. An apparatus as in claim 1 wherein each of said active elements comprises a varistor.

3. An apparatus as in claim 2 wherein said varistors are of the metal oxide semiconductor type.

4. An apparatus as in claim 1 wherein:

said apparatus further includes a printed circuit board disposed in said sheath; and wherein said plurality of active elements are connected together in series and disposed on said printed circuit board, each of said fixed voltage levels produced at a point where two of said active elements connect together, each of said points of connection including means for electrically connecting with one of said plurality of terminal means.

5. An apparatus as in claim 4 further including transient suppressing means, connected to said plurality of active element means and disposed on said printed circuit board, for decreasing the effect of the capacitance of said high voltage cable means.

6. An apparatus as in claim 5 wherein said transient suppressing means includes:

capacitor means, connected in parallel with said plurality of series-connected active element means, for storing an electrical charge; and diode means, connected to said capacitor means, for preventing said capacitor means from discharging substantially when the voltage produced by said generating means changes, in order to maintain voltage levels on said plurality of terminal means.

7. An apparatus as in claim 4 wherein:

said plurality of filaments share a common one of said terminal means;

said high voltage cable means includes means for producing a filament supply voltage to be applied to said common one of said terminal means; and said high voltage cable means includes means for electrically connecting said polarization voltage and said filament supply voltage to said printed circuit board.

8. An apparatus as in claim 7 wherein said electrically connecting means of said high voltage cable means comprises four electrical conductors.

9. An apparatus as in claim 7 wherein:

said generator means includes means for producing a reference potential; and wherein said high voltage cable means further includes a cable protective sheath connected to said reference potential and to said protective sheath means of said X-ray tube.

* * * * *